United States Patent [19]

Lowth

[11] 4,106,514

[45] Aug. 15, 1978

[54] ARTICLE OF WEARING APPAREL PROVIDING AN UNDERGARMENT

[75] Inventor: Leonard Cecil Lowth, London, England

[73] Assignee: Scholl Inc., Chicago, Ill.

[21] Appl. No.: 757,940

[22] Filed: Jan. 10, 1977

[51] Int. Cl.[2] ..... A41B 9/04

[52] U.S. Cl. ..... 128/519; 2/240; 2/409

[58] Field of Search ..... 2/406, 407, 409, 240, 2/401; 128/519, 528

[56] References Cited

U.S. PATENT DOCUMENTS

| | | | |
|---|---|---|---|
| 2,651,048 | 9/1953 | Milberg | 2/406 |
| 3,547,128 | 12/1970 | Keltner | 2/409 X |

FOREIGN PATENT DOCUMENTS

| | | | |
|---|---|---|---|
| 281,513 | 4/1966 | Australia | 2/406 |
| 961,658 | 6/1964 | United Kingdom | 2/409 |

*Primary Examiner*—H. Hampton Hunter

*Attorney, Agent, or Firm*—Hill, Gross, Simpson, Van Santen, Steadman, Chiara & Simpson

[57] ABSTRACT

A leg portion has at its upper end a first upper thigh, hip and abdomen covering section to the upper portion of which is connected a second upper thigh, abdomen and hip covering section for the opposite side of the wearer's body. A waistband is attached to the upper ends of the sections. An elastic crotch gusset is connected to and between the remaining lower portions of the sections and coacts with the sections to effect substantially uniformly tensioned engagement of the sections and the crotch gusset entirely about the wearer's upper thighs and groin areas. The crotch gusset and the second section define between them a downward leg opening through which the remaining leg of a wearer extends, and the crotch gusset and the second section each provide part of an edge for the leg opening and which edge snuggly engages about the upper thigh of the remaining leg of the wearer to restrain upward creeping of the second section. The garment is especially suitable for persons afflicted with varicose veins in the groin and upper thigh areas of the body, and possibly abdominal area.

16 Claims, 3 Drawing Figures

Fig. 1
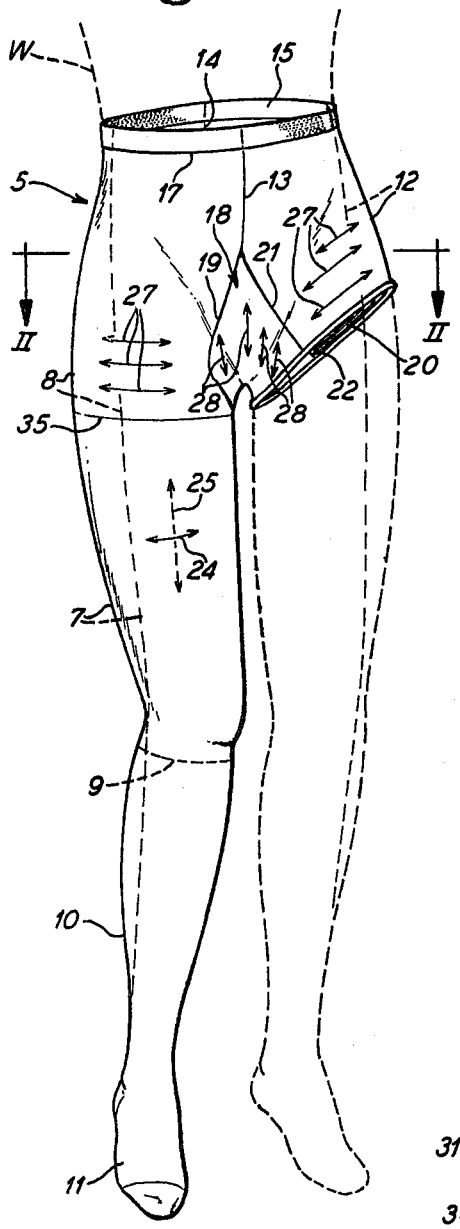
Fig. 2
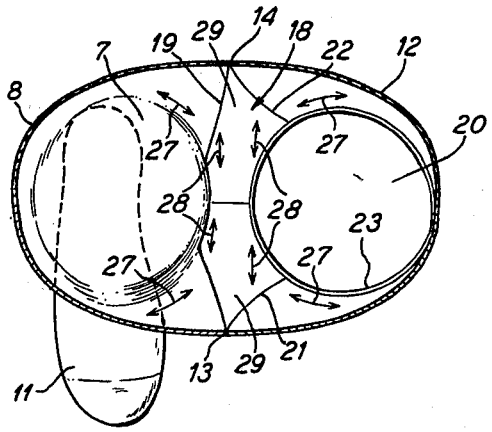
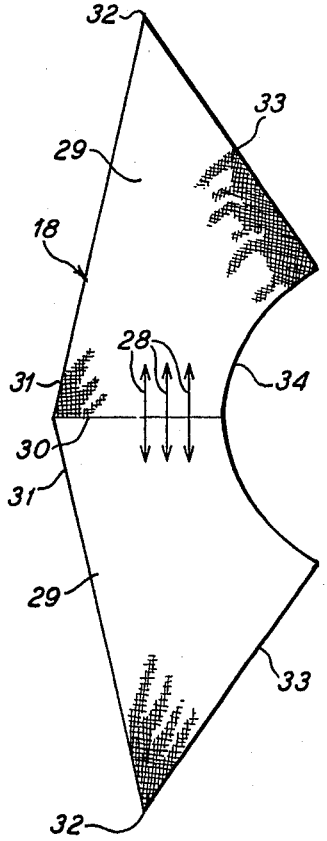
Fig. 3

ARTICLE OF WEARING APPAREL PROVIDING AN UNDERGARMENT

This invention relates to articles of wearing apparel providing undergarments and is more particularly concerned with such garments having surgical value in providing support for a wearer's abdomen, thighs, groin or legs, particularly where afflicted with varicose veins.

Sufferers from varicose veins in the legs above or below the knee have for many years been provided with stretch stockings incorporating elastic or elastomeric threads which cause the stockings to apply pressure around the leg, which eases the discomfort of varicose veins. Abdominal varicose veins, usually in the frontal region above the crotch, can be similarly supported by bands of such stretch material applied round the abdominal part of the torso, but varicose veins in the groin, and particularly the inner part of the groin, and upper thigh are difficult to support due to the shape of that part of the human body. Hitherto such support as was possible for varicose veins in all these regions of the body has been provided by separate garments or bandages.

An important object of the present invention is to provide a new and improved article of wearing apparel providing an undergarment which will in and of itself provide for support in the abdominal, thigh, groin and leg areas of the wearer's body.

According to the present invention there is provided an undergarment comprising, a leg portion shaped to cover at least the upper part of one of a wearer's legs from the knee up and attached at its upper end to a first upper thigh, hip and abdomen covering section for said one leg side of the wearer's body; a second upper thigh, abdomen and hip covering body section for the garment to engage supportingly with the opposite side of the wearer's body; a waistband to which upper ends of said sections are attached, upper portions of said sections being connected together for a limited vertical distance adjacent to said waistband, an elastic crotch gusset piece connected to and between the remaining lower portions of said sections and coacting with said sections to effect substantially uniformly tensioned supporting engagement of said sections and said gusset piece with the abdominal area and entirely about the wearer's upper thighs and groin areas, said gusset piece and said second section defining between them a downward leg opening through which the remaining leg of a wearer extends, and said gusset piece and said second section each providing part of an edge for said leg opening and which edge engages about the upper thigh of said remaining leg of the wearer to restrain upward creeping of said second section.

Contributing to the new and improved results attained with the article of wearing apparel according to the present invention, is the construction of the elastic crotch gusset, provided with front and rear generally triangularly shaped portions having at the side thereof which provides a portion of the downward leg opening, a concave, chordal recess substantially matching the radius of the free leg opening portion of the body of the article.

All parts of the article of wearing apparel are provided with desirable elasticity oriented for optimum support in the particular area of the body engaged by that part of the article.

Other objects, features and advantages of the invention will be readily apparent from the following description of certain representative embodiment thereof, taken in conjunction with the accompanying drawings although variations and modifications may be effected without departing from the spirit and scope of the novel concepts embodied in the disclosure and in which:

FIG. 1 is a front elevational view of an article of wearing apparel providing an undergarment, embodying features of the invention.

FIG. 2 is a horizontal sectional detail view taken substantially along the line II—II of FIG. 1; and FIG. 3 is a developed plan view of a preferred form of the crotch gusset piece of the article.

By way of example, there has been shown in FIG. 1 an article of wearing apparel providing an undergarment 5 embodying features of the invention and demonstrating the undergarment substantially as though worn by a wearer W depicted in phantom outline. In a preferred construction of the undergarment 5 to accommodate wearers afflicted with varicosities a leg portion 7 shaped to cover at least the upper part of one of the wearer's legs from the knee up is attached at its upper end to a first upper thigh, hip and abdomen covering section 8 for the side of the wearer's body having the leg covered by the portion 7. Where it is desired to have the leg portion 7 cover only the upper leg and lower thigh, the leg portion 7 may terminate at a line 9 just below the knee. Where a full length stocking is desired, a lower leg covering part 10 may be added to the leg portion 7 terminating in a foot receiving formation 11.

A second upper thigh, abdomen and hip covering section 12 for the opposite side of the wearer's body may be formed separately from but complementary to the first section 8, an upper portions of the sections being connected together for a limited vertical distance along front and rear seams 13 and 14 which may run out at their upper ends through a waistband 15 to which the upper ends of the sections 8 and 12 are attached along a seam 17.

Of substantial importance in the structure of the undergarment 5 for its intended purpose is an elastic crotch gusset piece 18 connected to and between the remaining lower portions of the sections 8 and 12 and coacting with the sections 8 and 12 to effect substantially uniformly tensioned supporting engagement of the sections and the gusset piece entirely about each of the wearer's upper thighs and groin areas and with the abdomen. Attachment of the crotch gusset 18 to the section 8 is preferably along a continuous seam 19 which runs entirely along the affected side of the gusset from its front end to its rear end. Where, as is in the preferred construction of the garment 5, only one leg portion is provided, the side of the gusset piece 18 which is attached to the body covering section 12 cooperates with this section to define between them a downward leg opening 20 (FIGS. 1 and 2) through which the remaining leg of the wearer extends. To this end the front portion of the gusset 18 is attached to the section 12 along a diagonal seam 21 running from the seam 13 to the leg opening 20, and the rear portion of the gusset 18 is attached to the section 12 along a seam 22 starting at the rear seam 14 and running out at the leg opening 20. Each of the crotch gusset 18 and the section 12 provides part of an edge 23 for the leg opening 20 and which edge may be suitably bound with an elastic circle strand or band whereby the edge 23 snuggly engages about the upper thigh of the remaining leg of the wearer to restrain upward creeping of the second section 12 during wear of the undergarment.

All of the structural components of the undergarment 5 are desirably made from elastically stretchable knitted fabric, the material for any particular component being knit from threads suitable for that component and employing knitting technique which is best suited for that component. Thus, in the leg portion 7 the knitting is preferably in a manner and with threads best suited for the surgical purpose of varicose vein support and wherein resilient tension is adapted to be greater in the horizontal direction as indicated by arrow 24, and of freer elasticity in the vertical direction indicated by the arrow 25. Also in the body covering sections 8 and 12, the denier and other characteristics of the thread, and the type of knitting employed should be selected to provide the best results for these components, and for optimum varicosity support resilient tension in the generally horizontal direction as indicated by the arrows 27 should be adequate for the intended purpose. Likewise as to the gusset 18 the denier and character of the threads and the type of knitting should be selected to serve the purpose of this component to optimum advantage. Because of the strain and wear to which the gusset 18 is subjected in use, and the service which it must preform, the knitted fabric from which the gusset is made is desirably of a tighter knit than need be in the leg portion 7 and the body sections 8 and 12. In the gusset 18 the major tension axis is in a generally front to rear direction as indicated by the arrows 28 so as to cooperate with optimum efficiency with the body sections 8 and 12 through the seams 19, 21 and 22 for the important function of snug engagement round-about the upper thighs and in the groin areas with substantially uniform tension and support whereby to provide effective varicosity relieving gentle pressure in these areas, and the abdomen.

As will be observed in the drawing, the gusset piece 18 is dimensioned both lengthwise or vertically and transversely or horizontally to engage supportingly with the wearer's inner thigh and groin and cooperates in mutually tensioned relation with the body section 12 on the one hand and the body section 8 on the other hand to provide efficient varicose vein support for the groin and the completely encircled upper thigh in each instance, as well as the hip and abdomen areas.

In a desirable construction as best visualized in FIG. 3, the gusset 18 comprises substantially equal opposite generally isoceles triangular portions 29 either of which may be located at the front or rear of the undergarment. Although the gusset 18 may be formed from a single piece of material cut to proper dimensions, for manufacturing convenience each of the portions 29 may be separately formed according to a common pattern and then united into one integral piece along a transverse seam 30. According to the preferred geometry of the gusset piece 18, the longitudinally opposite portions 29 are in a substantially back-to-back relation along the line 30. At one side respective oblique edges 31 of the portions 29 meet at an angular juncture at the conjoint end of the line 30. At their distal ends the side edges 31 terminate at respective apices 32 from which extend respective opposite side edges 33 which are desirably at a more obtuse angle to an axis between the apices 32 than the more acute oblique angularity of the side edges 31. At their ends remote from the apices 32, the side edges 33 run out at the opposite ends of an arcuate chordal recess 34 in the gusset member, symmetrical with respect to the gusset portions 29 and on a radius of curvature complementary to the radius of curvature of the edge 23 defining the leg opening 20. In a practical geometric relationship, the chord across the opposite ends of the arc of the recess 34 may be slightly less than $\frac{1}{3}$ of the circumference of the edge 23.

In the fully assembled undergarment, the side edges 31 of the gusset piece 18 are attached to the body section 8 along the seam 19, whereby the gusset piece closes an opening provided for this purpose at the inner side of the section 8 between the lower ends of the front and back seams 13 and 14 and above the circularly knit lower end of the section 8 which may, as shown, be integrally joined to the top of the circularly knit leg portion 7 along a circular knit joint 35 (FIG. 1). At its opposite side, the edges 33 of the gusset piece 18 are attached to the body section 12 along the respective seams 21 and 22. The binding about the edge 23 of the leg hole 20 is desirable continuous along the lower edge of the body section 12 and the arcuate edge defining the recess 34.

In the completed undergarment 5, it will be observed with the aid of the tension-indicating arrows 27 and 28 that the gusset piece 18 cooperates with the body sections 8 and 12 to effect substantially uniform encircling tension entirely about the upper thigh and to effect supporting pressure in the groin areas of the wearer. Further, the desirable major tension axes of the gusset piece 18 and the body sections 8 and 12 is so related through the portions 29 of the gusset piece and the attachments thereof to the body sections 8 and 12 as to provide an advantageous tensioned engagement pressure on the wearer's abdomen and enhance the supporting pressure in the groin areas. Thereby firm but gentle varicosity support is provided throughout the upper thigh, groin and abdomen areas of the wearer, where varicose affliction is most likely to be present insofar as the lower torso and upper thigh areas are concerned. Where the wearer is afflicted with varicosity in the lower thigh, the leg portion 7 above the knee will provide the necessary support. Where varicose vein support on the lower leg is desired, the stocking portion 10 will provide such support.

A desirable attribute of an undergarment according to the present invention having only one leg portion resides in that it is much easier to put on than a two legged garment, it provides better varicosity support for the upper thigh and groin areas, there is less stress on seams in the panty portion of the garment during putting on and in sitting and walking. There is less strain when walking because there is no drag of one leg portion on the other leg portion of the garment. In addition it has been found that the one legged garment is more comfortable for the wearer. Although the undergarment 7 has only one leg portion, and it will be understood the leg portion may be at either side of the garment, where the wearer requires varicosity support for both legs, two such undergarments may be worn simultaneously, especially where fairly severe varicosity is present in the upper thigh and groin regions and the double support provided by the two body encircling portions of the two garments combined will afford desirable dual support. On the other hand, where the dual upper support is not desired, the wearer may use a regular surgical stocking on the free leg, or an ordinary stocking generally matching the weave of the attached leg portion of the undergarment may be worn on the free leg if no varicosity problem is present in that leg.

In putting on the undergarment 5, the wearer dons the garment by first extending both feet through the waistband 15 and the body portion of the garment, one foot and leg passing on through the opening 20 and the other foot and leg being engaged in the leg portion 7, the garment then being fully drawn up to full waist height on the wearer's body and then held by the waistband 15 which is preferably elastic but may be of the button fastening type if preferred. If a second allochiral garment is to be applied, the procedure is repeated wherein the first free leg is engaged in the leg portion of the second garment and the stockinged opposite leg is passed through the side opening 20 in the second garment.

It will be understood that variations and modifications may be effected without departing from the spirit and scope of the novel concepts of this invention.

I claim as my invention:

1. An article of wearing apparel providing an undergarment which will in and of itself provide for support in the abdominal, thigh, groin and leg areas of the wearer's body, comprising:

a leg portion shaped to cover at least the upper part of one of a wearer's legs from the knee up and attached at its upper end to a first upper thigh, hip and abdomen covering body section for said one leg side of the wearer's body;

a second upper thigh, abdomen and hip covering body section for the opposite side of the wearer's body;

a waistband to which upper ends of said sections are attached;

upper portions of said sections being connected together for a limited vertical distance adjacent to said waistband;

an elastic crotch gusset piece connected to and between the remaining lower portions of said sections and coacting with said sections to effect substantially uniformly tensioned engagement of said sections and said gusset piece entirely about each of the wearer's upper thighs, and in the hip, groin and abdomen areas;

said gusset piece and said second section defining between them a downward leg opening through which the remaining leg of a wearer extends;

said gusset piece and said second section each providing a substantial circumferential part of an edge for said leg opening and which edge engages in completely encircling relation about the upper thigh of said remaining leg of the wearer to restrain upward creeping of said second section;

and said gusset piece being dimensioned both vertically and horizontally to engage supportingly with the wearer's inner thigh and groin and being cooperative in mutually tensioning relation with said second section for efficient vericose vein support for the groin and the completely encircled upper thigh of the wearer's engaged leg, as well as the hip and abdomen areas.

2. An article according to claim 1, wherein said crotch gusset piece has front and back triangularly shaped portions and a chordal concave recess in its edge nearest said second section defining the crotch gusset piece portion of said leg opening.

3. An article according to claim 1, wherein said edge for said leg opening comprises a substantially continuous binding having elastic means therein.

4. An article according to claim 1, wherein said first section has a continuous thigh encircling lower end portion and an inner side opening toward said second section defined by a continuous edge below the connections of the upper portions of the sections, and said gusset piece has one side edge joined to said continuous edge along a continuous seam.

5. An article according to claim 4, wherein said gusset piece has on its opposite side edges extending substantially diagonally from opposite ends of the gusset piece to the front and rear of said leg opening, and said opposite side edges being joined to said second section along seams extending between said leg opening and the connections of said upper portions of said sections.

6. An article according to claim 1, wherein said gusset piece comprises generally triangular oppositely extending front and rear portions providing a continuous edge along one side of the gusset piece attached along a continuous seam to said first body section, and the opposite side of said gusset piece having generally obliquely convergent edges along said gusset portions terminating at opposite ends of a symmetrical recess in said opposite side, said recess defining the gusset piece portion of said leg opening, and seams joining said convergently related edges to said second body section.

7. An article according to claim 6, wherein said gusset piece comprises a pair of separately formed substantially triangular gusset parts joined along a seam midway of said recess.

8. An article according to claim 1, wherein said body sections and said gusset piece are all made from elastically stretchable knit material, said body sections having major elastic tension in horizontal direction, and said gusset piece having major elastic tension in a generally front to rear direction whereby to complement the major elastic tension of said body sections in attaining optimum uniformly tensioned engagement about each of the wearer's upper thighs, groin and abdomen areas.

9. An article of wearing apparel providing an undergarment having downwardly extending leg openings therein which will in and of itself provide for support in the abdominal, thigh, groin and leg areas of the wearer's body, comprising:

a body encircling portion having a first upper thigh, hip and abdomen covering body section at one side and a second upper thigh, abdomen and hip covering body section at the opposite side, a waistband to which upper ends of said sections are attached;

upper portions of said sections being connected together for a limited vertical distance adjacent to said waistband;

an elastic crotch gusset piece connected to and between the remaining lower portions of said sections and coacting with said sections to effect substantially uniformly tensioned engagement of said sections and said gusset piece entirely about each of the wearer's upper thighs and in the groin and abdomen areas;

said gusset piece and at least one of said sections defining between them one of said downward leg openings through which a leg of a wearer extends;

said gusset piece and said one section each providing a substantial circumferential part of an edge for said leg opening and which edge engages in completely encirling relation about the thigh of the leg which extends through the leg opening whereby to restrain upward creeping of said one section;

and said gusset piece being dimensioned both vertically and horizontally to engage supportingly with the wearer's inner thigh and groin and being cooperative in mutually tensioning relation with said one section for efficient vericose vein support for the groin and the completely encircled upper thigh of the wearer's engaged leg, as well as the hip and abdomen areas.

10. An article according to claim 9, wherein the other of said sections has attached to its lower end a leg portion shaped to cover at least the upper part of the wearer's leg engaged through said leg portion.

11. An article according to claim 9, wherein said crotch gusset piece has front and back triangularly shaped portions and a chordal concave recess in its edge nearest said one section defining the crotch gusset piece portion of said leg opening.

12. An article according to claim 9, wherein said edge for said leg opening comprises a substantially continuous binding having elastic means therein.

13. An article according to claim 12, wherein said gusset piece has side edges extending to the front and rear of said leg opening, and said side edges being joined to said one section along seams extending between said leg opening and the connections of said upper portions of said sections.

14. An article according to claim 9, wherein said gusset piece comprises generally triangular oppositely extending front and rear portions, and the side of said gusset piece which is connected to said one section having generally obliquely convergent edges along said gusset portions terminating at opposite ends of a symmetrical recess in said side, said recess defining the gusset piece portion of said leg opening, and seams joining said convergently related edges to said one body section.

15. An article according to claim 14, wherein said gusset piece comprises a pair of separately formed substantially triangular gusset parts joined along a seam mid-way of said recess.

16. An article according to claim 9, wherein said body sections and said gusset piece are all made from elastically stretchable knit material, said body sections having major elastic tension in horizontal direction, and said gusset piece having major elastic tension in a generally front to rear direction whereby to complement the major elastic tension of said body sections in attaining optimum uniformly tensioned engagement about each of the wearer's upper thighs, and in the groin and abdomen areas.

* * * * *